US011311078B2

(12) United States Patent
Patel

(10) Patent No.: US 11,311,078 B2
(45) Date of Patent: Apr. 26, 2022

(54) SHOE ASSEMBLY

(71) Applicant: Y-Heels Limited, London (GB)

(72) Inventor: Yaagni Patel, London (GB)

(73) Assignee: Y-Heels Limited, London (GB)

( * ) Notice: Subject to any disclaimer, the term of this patent is extended or adjusted under 35 U.S.C. 154(b) by 0 days.

(21) Appl. No.: 16/888,736

(22) Filed: May 31, 2020

(65) Prior Publication Data

US 2020/0375314 A1 Dec. 3, 2020

(30) Foreign Application Priority Data

May 31, 2019 (GB) ..... 1907795

(51) Int. Cl.

| | |
|---|---|
| ***A43B 21/37*** | (2006.01) |
| ***A43B 21/52*** | (2006.01) |
| ***A43B 21/47*** | (2006.01) |
| ***A43B 21/48*** | (2006.01) |
| ***A43B 13/14*** | (2006.01) |

(52) U.S. Cl.

CPC ..... *A43B 21/52* (2013.01); *A43B 13/141* (2013.01); *A43B 21/37* (2013.01); *A43B 21/47* (2013.01); *A43B 21/48* (2013.01)

(58) Field of Classification Search

CPC ..... A43B 21/36; A43B 21/37; A43B 21/47; A43B 21/48; A43B 21/42; A43B 21/52; A43B 3/244; A43B 13/141

See application file for complete search history.

(56) References Cited

U.S. PATENT DOCUMENTS

| | | | | | |
|---|---|---|---|---|---|
| 1,142,662 | A | * | 6/1915 | Blaney | A43B 21/37 36/36 R |
| 1,156,769 | A | * | 10/1915 | Fortin | A43B 21/37 36/36 R |
| 1,764,000 | A | * | 6/1930 | Bernier | A43B 21/36 36/36 R |
| 3,797,136 | A | * | 3/1974 | Soleri | A43B 21/37 36/42 |
| 4,400,893 | A | * | 8/1983 | Musci | A43B 21/42 36/24.5 |
| 5,347,730 | A | * | 9/1994 | Rodriguez Colon | A43B 3/24 36/100 |
| D378,548 | S | * | 3/1997 | Harman, II | D2/925 |

(Continued)

FOREIGN PATENT DOCUMENTS

| | | |
|---|---|---|
| EP | 2474245 | 7/2012 |
| GB | 2538967 | 12/2016 |

(Continued)

OTHER PUBLICATIONS

Patents Act 1977: Search Report Under Section 17(5) dated Jan. 7, 2020 From the Intellectual Property Office of the United Kingdom of Great Britain Re. Application No. GB1907795.7. (5 Pages).

*Primary Examiner* — Ted Kavanaugh

(57) ABSTRACT

There is provided a shoe assembly, comprising: a shoe body having: a first outer side which faces the ground when the shoe is used in a standing position; and at least one further outer side; and an attachable and detachable heel for the shoe body; a securement mechanism for securing the heel to the shoe body; and a release mechanism for releasing the securement mechanism, said release mechanism being located on a further outer side.

11 Claims, 10 Drawing Sheets

(56) References Cited

U.S. PATENT DOCUMENTS

| | | | | |
|---|---|---|---|---|
| 8,132,341 | B1 | 3/2012 | Laramore | |
| 8,938,891 | B2 * | 1/2015 | Kemp | A43B 21/48 36/100 |
| 2001/0052195 | A1 * | 12/2001 | Blakey | A43B 21/50 36/100 |
| 2003/0136028 | A1 | 7/2003 | Magallanes et al. | |
| 2013/0067770 | A1 | 3/2013 | Sherwood et al. | |
| 2014/0259777 | A1 | 9/2014 | Morris Thill | |
| 2016/0198795 | A1 | 7/2016 | Lopez-Velasquez et al. | |
| 2017/0042276 | A1 | 2/2017 | Alan | |
| 2017/0156441 | A1 * | 6/2017 | Ho | A43B 13/42 |
| 2020/0268102 | A1 * | 8/2020 | Carter | A43B 21/39 |

FOREIGN PATENT DOCUMENTS

| | | |
|---|---|---|
| GB | 2574892 | 12/2019 |
| KR | 10-2013-0050697 | 5/2013 |
| KR | 10-2014-0102426 | 8/2014 |
| KR | 10-2014-0139794 | 12/2014 |
| WO | WO 2017/027804 | 2/2017 |

* cited by examiner

SHOE ASSEMBLY

RELATED APPLICATION

This application claims the benefit of priority of United Kingdom Patent Application No. 1907795.7 filed on May 31, 2019, the contents of which are incorporated herein by reference in their entirety.

FIELD AND BACKGROUND OF THE INVENTION

This invention relates to a shoe assembly. More specifically, this invention relates to a shoe assembly having attachable and detachable heels, a shoe body, and a heel itself.

Wearing high heeled shoes can cause pain or discomfort to the wearer, even after just short periods of use. Insoles or gels can be used to relieve pain for short periods of time but, for people reliant on wearing heels every day, this does not alleviate long-term health problems.

To minimise such pain or discomfort, many people will wear alternative footwear throughout the day, except at the times they wish to change into high heeled shoes. This causes inconvenience to the wearer as they must keep their high heeled shoes when not using them, and keep their alternative footwear when wearing the high heeled shoes.

SUMMARY OF THE INVENTION

Aspects and embodiments of the present invention are set out in the appended claims. These and other aspects and embodiments of the invention are also described herein.

According to at least one aspect described herein, there is provided a shoe assembly, comprising: a shoe body having: a first outer side which faces the ground when the shoe is used (by a user) in a standing position; and at least one further outer side; and an attachable and detachable heel for the shoe body; a securement mechanism for securing the heel to the shoe body; and a release mechanism for releasing the securement mechanism, said release mechanism being located on a (or the) further outer side. This may allow easy-to-use attachment and detachment of the heel.

In other words, the release mechanism is located on an outer part of the shoe body which, in use, does not contact the ground and/or which is arranged such that the release mechanism faces away from the ground when the shoe is used in a standing position. The outer part of the shoe body in which the release mechanism is used is exposed in use.

Preferably, the shoe body comprises a sole; the release mechanism being located on a side of the sole. Preferably, the release mechanism is located on the rear of the shoe.

The securement mechanism/release mechanism may comprise a resilient component, where actuation of the release mechanism may be configured to compress the resilient component. The release mechanism may comprise a button integral to the resilient component. The button preferably extends through the further outer side. The resilient component may be a spring-loaded plate.

The securement mechanism preferably comprises a first formation in the shoe body and a second formation in the attachable and detachable heel, wherein the first and second formation are configured to engage thereby to secure the heel to the shoe body. The shoe body may comprise an integral heel, wherein the integral heel spaces the first formation from the ground in use.

In another aspect, there is provided a shoe assembly, comprising: a shoe body having an integral heel; and an attachable and detachable heel for the shoe body; wherein the shoe body comprises a securement component for securing the attachable and detachable heel to the shoe body; wherein, in use, the integral heel spaces the securement component from the ground. This may allow the shoe body to be used without the attachable and detachable heel without risking damage to the securement component in use.

The attachable and detachable heel may comprise a cavity for receiving the integral heel. The integral heel may have a tapered shape. The securement component may be a first formation and the attachable and detachable heel may comprise a second formation, wherein the first and second formation may be configured to engage thereby to secure the heel to the shoe body. The second formation may comprise an aperture for receiving the integral heel therethrough.

The first formation may comprise a or the resilient component, wherein the second formation may comprise a catch for engaging with the resilient component, such that the catch and resilient component form a latch. A latching member may be provided on the resilient component accordingly. The second formation may further comprise a hook for engaging with a part of the first formation. The resilient component may be a sprung plate, being attached to an outer part of the first formation. The hook may engage with said outer part, which may be a ledge, behind the sprung plate. The hook may be provided generally on an opposite side of the second formation to the catch.

The first formation may be located in the sole. The shoe body may comprise a cap for covering the first formation and/or the release mechanism, wherein the cap may form part of an insole. The second formation may be located on an upper part of the heel.

The shoe body may comprise a sole having a flexible part thereby to adapt to different heel heights. The shoe body may further comprise a shank, wherein the flexible part is located away from the shank.

In another aspect, there is provided a shoe body comprising: a first outer side which faces the ground when the shoe is used in a standing position; and at least one further outer side; a formation for engaging with a further formation on an attachable and detachable heel thereby to form a securement mechanism; and a release mechanism located on a further outer side for releasing the securement mechanism.

In another aspect, there is provided a shoe body comprising: an integral heel; a formation for engaging with a further formation on an attachable and detachable heel thereby to form a securement mechanism; wherein, in use, the integral heel spaces the securement component from the ground.

In another aspect, there is provided an attachable and detachable heel for a shoe body comprising a formation for engaging with a formation on a shoe body thereby to form a securement mechanism.

In another aspect, there is provided a kit of parts comprising a shoe body as described herein and a plurality of attachable and detachable heels as described herein. The plurality of attachable and detachable heels are preferably of different heights and/or styles.

Any apparatus feature as described herein may also be provided as a method feature, and vice versa. As used herein, means plus function features may be expressed alternatively in terms of their corresponding structure.

Any feature in one aspect of the invention may be applied to other aspects of the invention, in any appropriate combination. In particular, method aspects may be applied to apparatus aspects, and vice versa. Furthermore, any, some and/or all features in one aspect can be applied to any, some and/or all features in any other aspect, in any appropriate combination. It should also be appreciated that particular combinations of the various features described and defined in any aspects of the invention can be implemented and/or supplied and/or used independently.

As used herein, the terms 'front' and 'rear' used in relation to a shoe preferably connote the regions of the shoe at the toe end and heel end of the shoe respectively. The words 'frontward' and 'rearward' from a location preferably connote the direction from that location towards the front or rear of the shoe respectively.

As used herein, the terms 'top' and 'bottom' used in relation to a shoe preferably connote the region of the shoe which a user's leg extends from and the region of the shoe which contacts the ground, respectively. The words 'above' and 'below' from a location preferably connote the direction from that location towards the top or bottom of the shoe respectively.

As used herein, the term "inner" used in relation to a shoe preferably connotes the parts or surfaces of the shoe which contact or face towards a user's foot in use. Vice versa, as used herein the term "outer" used in relation to a shoe preferably connotes the parts or surfaces of the shoe which do not contact or face away from a user's foot in use.

As used herein, the term 'sole' preferably connotes a component of the shoe which is located at the bottom of the shoe, which contacts the ground and/or interposes between a user's foot and the ground in use.

As used herein, the term 'heel' preferably connotes a part of the shoe which supports a user's heel (i.e. the back part of the foot below the ankle); preferably a part which is raised thereby to space at least a part of the sole from the ground.

The invention extends to methods, system and apparatus substantially as herein described and/or as illustrated with reference to the accompanying figures.

BRIEF DESCRIPTION OF THE SEVERAL VIEW OF THE DRAWINGS

One or more aspects will now be described, by way of example only and with reference to the accompanying drawings having like-reference numerals, in which:

FIG. 1*a* is a side view of a shoe assembly in assembled form;

FIG. 1*b* is the shoe assembly in a disassembled form;

FIGS. 2*a* and 2*b* are perspective views of the shoe assembly in a disassembled form;

FIG. 3*a* is a view of the shoe assembly, in disassembled form, as viewed from behind;

FIG. 3*b* is a view of the shoe assembly, in assembled form, as viewed from behind;

Figure 7B:
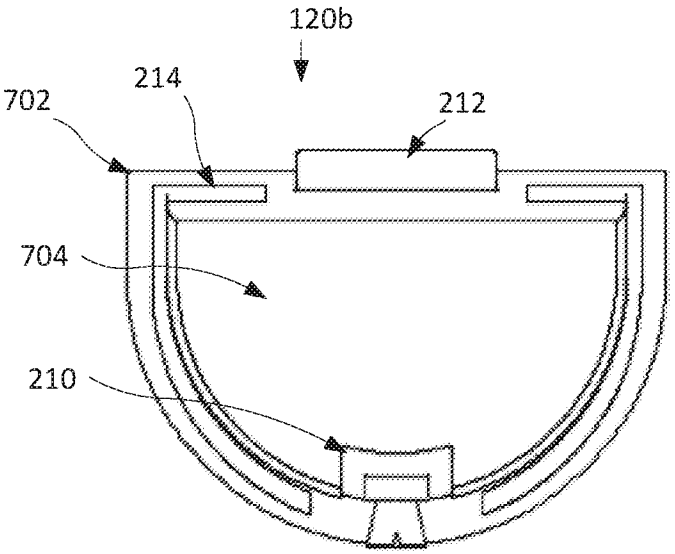
Figure 7A:
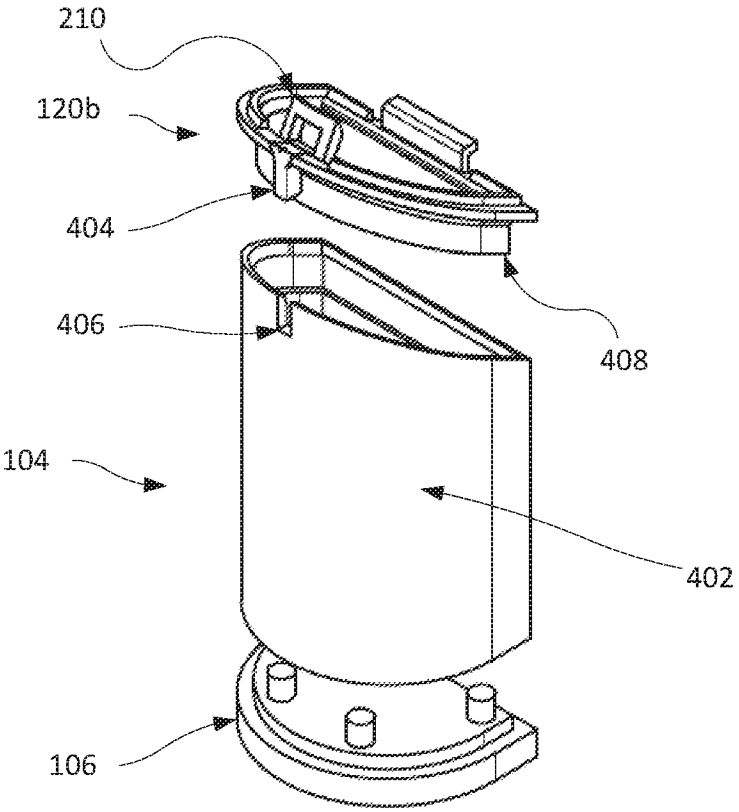

FIG. 7*a* is an exploded view of the attachable and detachable heel;

FIG. 7*b* is a plan view of the attachable and detachable heel; and

Figure 8:
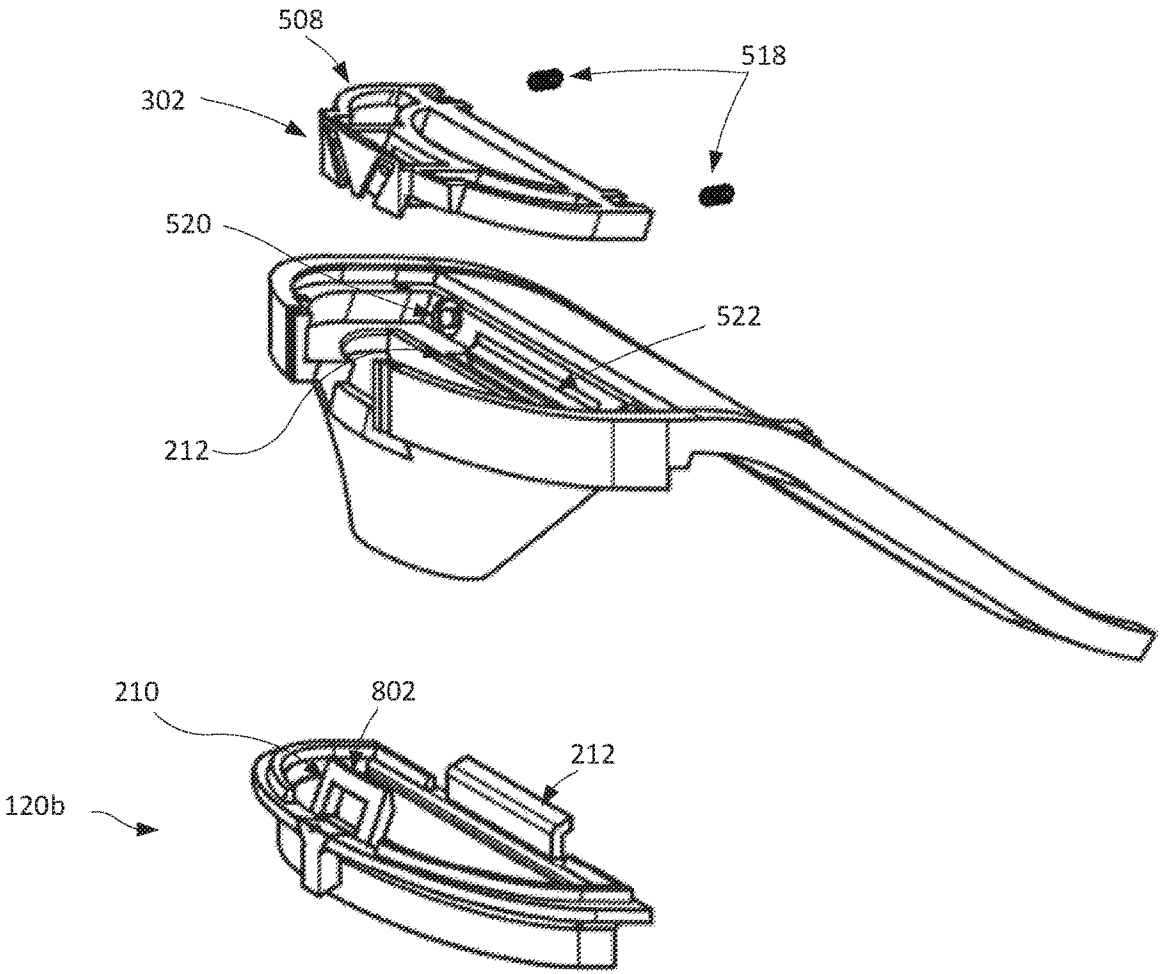

FIG. 8 is an exploded view of the securement mechanism for securing the attachable and detachable heel to the shoe body.

DESCRIPTION OF SPECIFIC EMBODIMENTS OF THE INVENTION

Figure 1A:
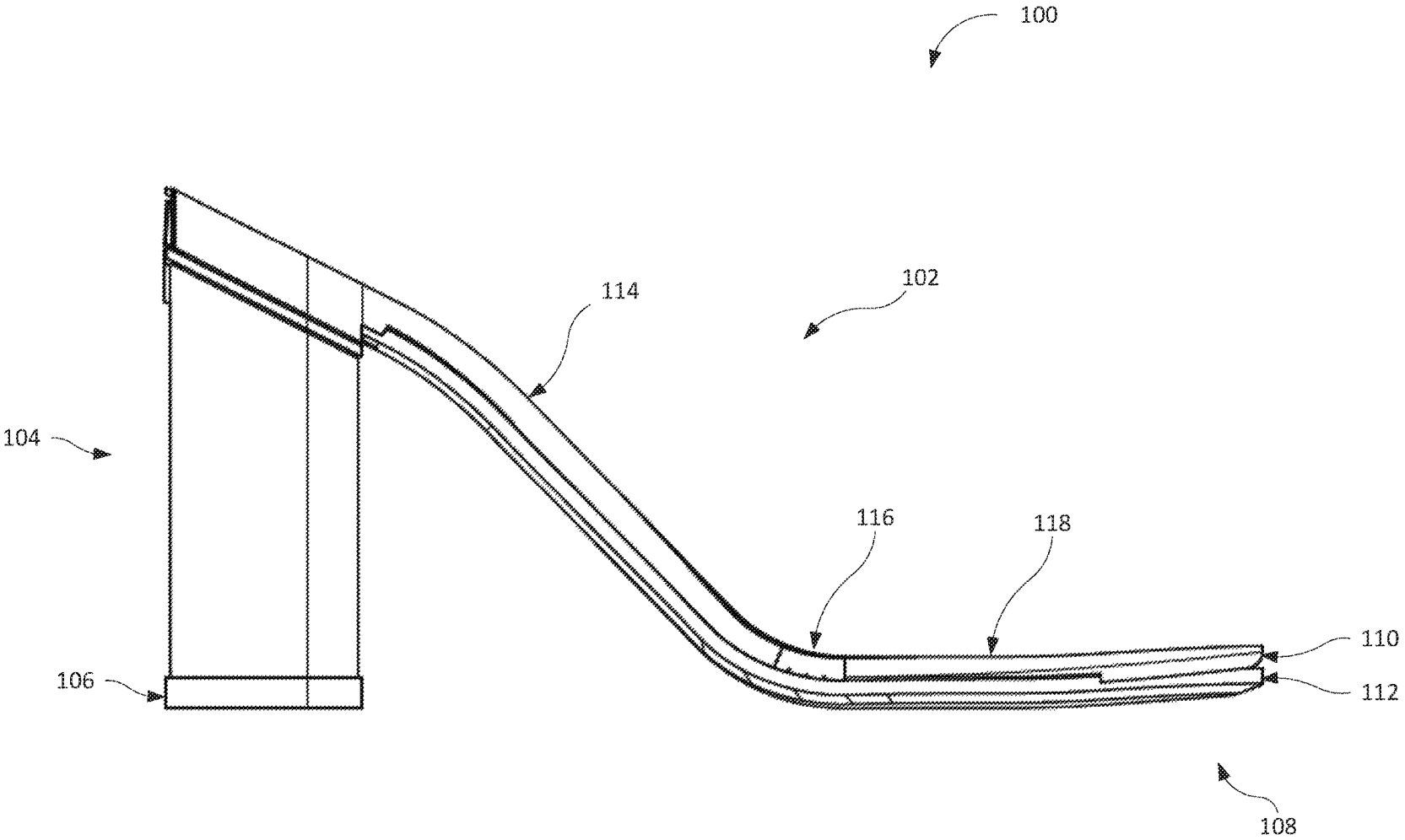

FIG. 1*a* is a side view of a shoe assembly 100 in assembled form. The shoe assembly comprises a shoe body 102, and an attachable and detachable heel 104 positioned at the rear of the shoe body. The heel 104 has a heel cap 106. The heel is shown as attached to the shoe body in FIG. 1*a*.

The shoe body has a sole 108 which has an insole 110 and an outsole 112. The insole is made from three parts: a heel part 114; a flexible part 116; and a toe part 118. The flexible part is positioned in prolongation of the heel part, and the toe part is positioned in prolongation of the flexible part, such that the flexible part is connected between the heel part and toe part. The flexible part is made from a flexible material. The shoe body 102 has a curved shape which results both from the fixed shape of the heel part and toe part, as well as the variable angle between the heel part and toe part permitted by the flexible part between them.

The outsole 112 is positioned on the underneath of the insole 110 and is attached to it. The underneath of the heel cap 106 and the underneath of the outsole 112 are preferably made from durable and grippy material. The outsole 112 is formed as a single part; however it could instead be formed of three parts equivalent to the three parts of the insole, where each part of the outsole is attached on the underneath of its corresponding part of the insole. The outsole include a first outer side which faces the ground when the shoe is used in a standing position (i.e. the lower surface of the outsole).

The heel 104 is detachable from the shoe body 102 as described below. When the heel 104 is attached to the shoe body, the shoe 100 can be used in the normal manner of a high heeled shoe, in that a user places their foot on top of the upper surface of the insole 110, and when walking the underneath of the heel cap 106 and the underneath of the outsole 112 (in particular the flat portion of the outsole underneath the toe part 118) contact the ground.

The shoe 100 may have a shoe upper (not shown) which may comprise means for securing the shoe to a user's foot, such as a vamp and/or toe box particularly shaped to enclose parts of the user's foot and/or one or more straps.

Figure 1B:
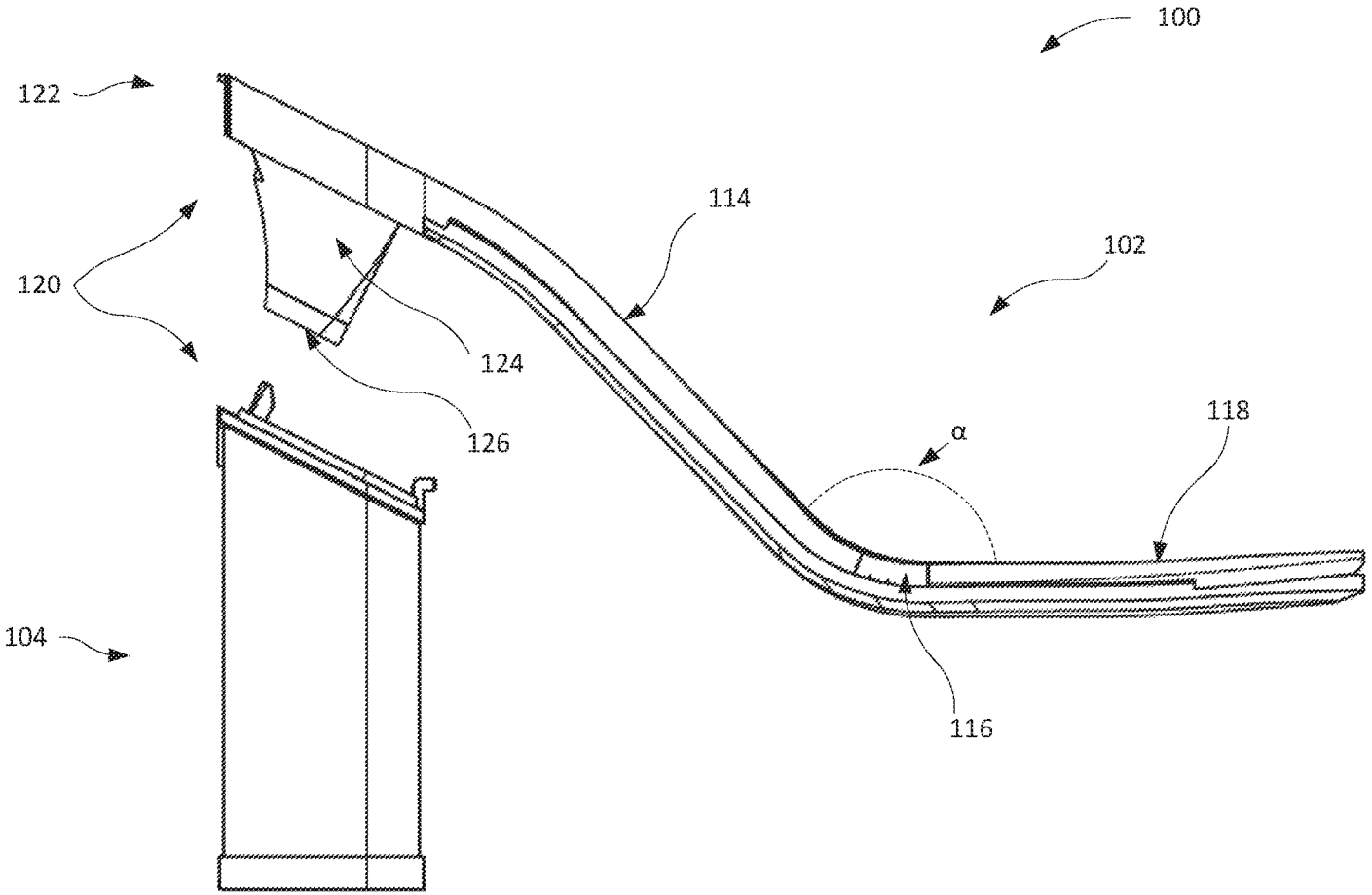

FIG. 1*b* is a side view of the shoe assembly 100 in disassembled form. In disassembled form the heel 104 is detached from the shoe body 102.

The shoe 100 has a securement mechanism 120, by which the attachable and detachable heel 104 is attached to the shoe body 102. The shoe also has a release mechanism 122, for releasing the securement mechanism, by which the heel 104 is detached from the shoe body.

The shoe body 102 comprises an integral heel 124 attached to the rear of the shoe body 102. The integral heel 124 has a tapered shape and a heel cap 126. The integral heel 124 is not detachable from the shoe body, and may either be formed as a single piece with the shoe body (for example, as a part of the heel part 114) or it may be a separate part from the shoe body but permanently fixed to the shoe body. The integral heel 124 is shorter than the attachable and detachable heel 104.

The shoe 100 can be worn with the heel 104 detached from the shoe body 102. When the heel 104 is detached from the shoe body, the shoe body can be worn in the normal manner of a low heeled shoe, in that a user places their foot on top of the upper surface of the insole 110, and when walking the underneath of the heel cap 126 of the integral heel 124 and the underneath of the outsole 112 (in particular the flat portion of the outsole underneath the toe part 118) contact the ground.

When walking in the shoe 100 with the detachable heel 104 detached from the shoe body 102, the rear of the shoe body is much closer to the ground than in the case where the attachable and detachable heel 104 is attached. In this case, the flexible material of the flexible part 116 of the insole 110 allows the shoe to adapt to different heel heights. When the heel 104 is detached, the flexible part allows the angle α between the heel part 114 and the toe part 118 to increase so that the integral heel 124 contacts the ground. The shoe body therefore flattens resulting in a more comfortable shoe.

Figure 2A:
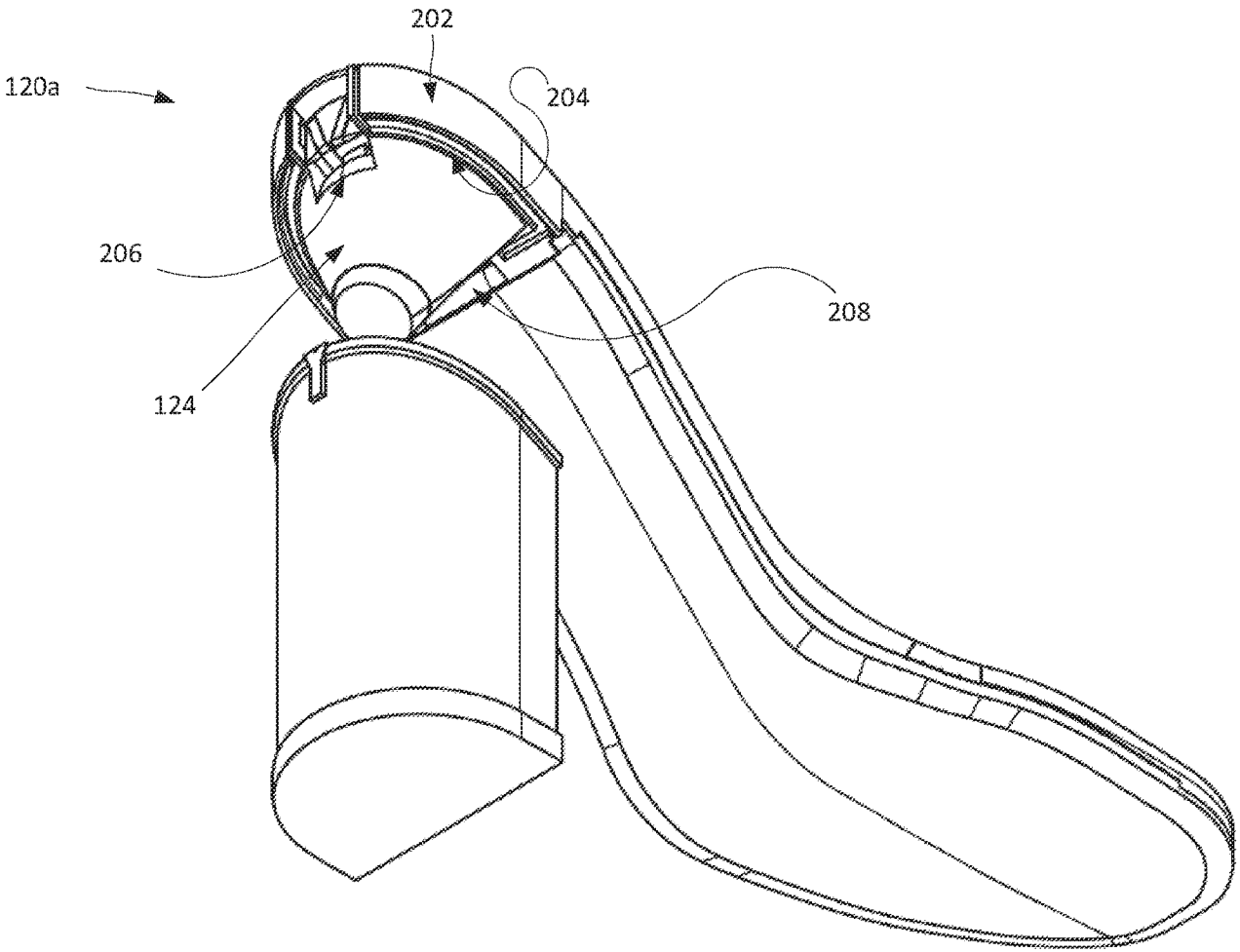

FIG. 2*a* is a perspective view of the shoe assembly in a disassembled form, as viewed from below, showing aspects of securement mechanism 120.

The securement mechanism 120 has a first formation 120*a* which is comprised in the shoe body 102. The first formation 120*a* of the securement mechanism 120 is located at the rear of the shoe body 102 and has features around the integral heel 124. The rear of the shoe body 102 has a lip 202 which surrounds most of the integral heel 124 and covers parts of the securement mechanism 120 both when the heel 104 is attached and detached. The first formation 120*a* has a groove 204. The groove is positioned between the integral heel and the lip 202 and surrounds most of the integral heel.

At the rearmost point of the shoe body there is a gap in the lip 202, and a portion of the integral heel 124 is cut out. The cut out portion has a width which substantially matches the width of the gap in the lip 202. The gap in the lip 202 and the cut out portion of the integral heel together form an opening 206 which is accessible from below.

The first formation 120*a* of the securement mechanism 120 also comprises a slit 208 in the sole 108. The slit 208 is positioned beside the integral heel 124, on the side of the integral heel which is towards the front of the shoe 100.

When the attachable and detachable heel 104 is detached from the shoe body 102, and the user wears the shoe 100 to walk in, the integral heel 124 contacts the ground to bear the weight of the user. Advantageously, the integral heel 124 therefore spaces the first formation 120*a* from the ground in use. This avoids the first formation 120*a* bearing the weight of the user and thus protecting the first formation 120*a* from damage where the attachable and detachable heel is not used—thereby allowing the shoe to be used reliably without the attachable and detachable heel 104.

Without the integral heel, a user who removes the detachable heel 104 from the shoe body 102 would need to attach a replacement heel to the shoe body in order to continue walking in the shoe without damaging the securement mechanism. In the case of the present invention, no such replacement heel is needed and the user can continue to walk in the shoe using the integral heel.

Figure 2B:
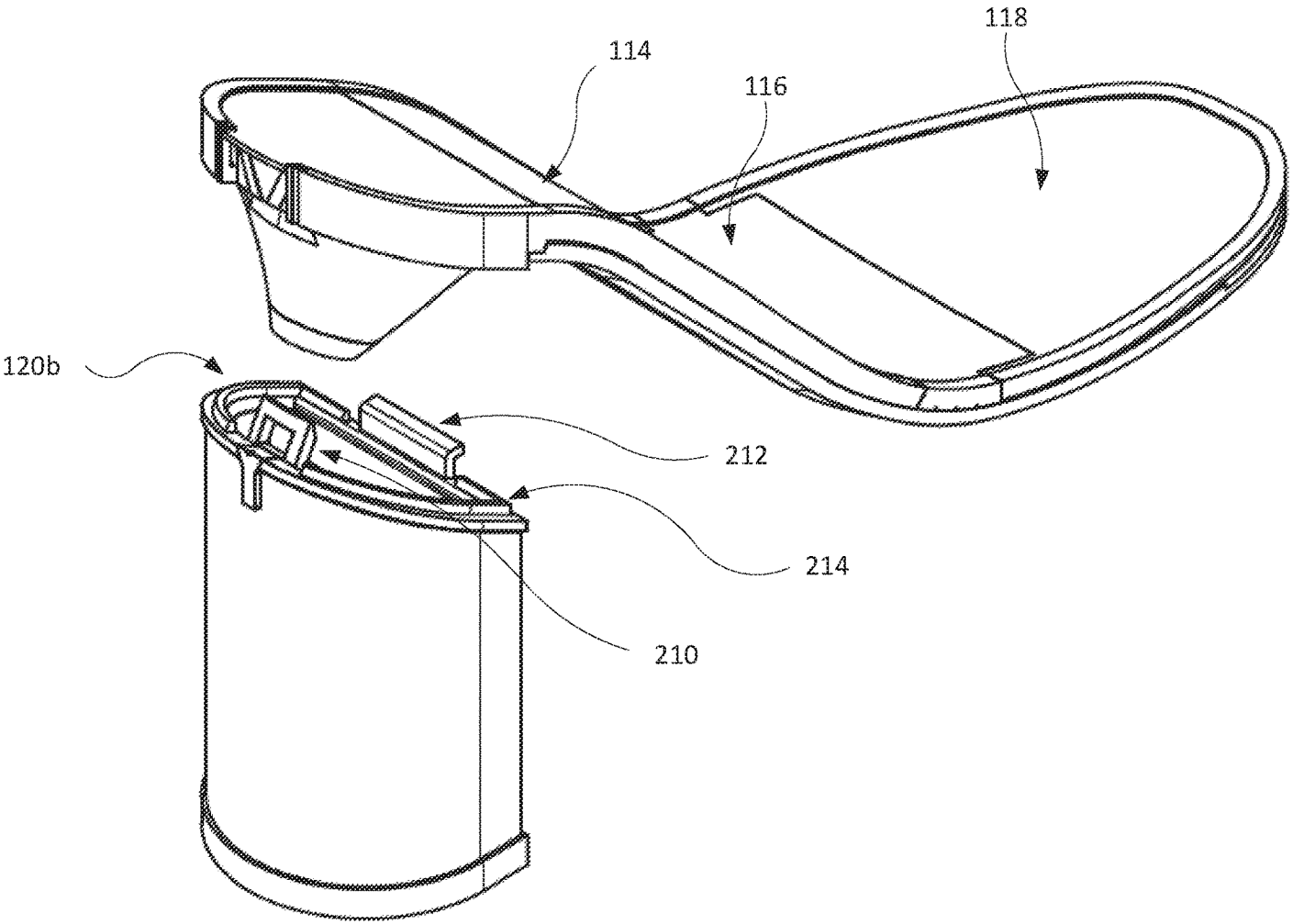

FIG. 2*b* is a perspective view of the shoe assembly in a disassembled form, as viewed from above, showing aspects of the securement mechanism as well as the heel part 114, flexible part 116, and toe part 118 of the insole 110.

The securement mechanism 120 has a second formation 120*b* comprised in the attachable and detachable heel 104. The second formation 120*b* is located on an upper part of the attachable and detachable heel 104. The second formation has a catch 210 and a hook 212. The catch and the hook project in a direction substantially away from the top of the heel 104.

The catch 210 is positioned at the rear of the second formation 120*b* and the hook 212 is positioned at the front of the second formation. The second formation 120*b* has a ridge 214 which runs around substantially the whole of the perimeter of the top of the heel 104.

The catch 210 is shaped as a loop having a hole through its centre, and the hook 212 is a protrusion from the top of the heel 104. The hook 212 is attached to the top of the heel 104 at its proximal end. The hook 212 has a vertical component projecting substantially away from the top of the heel 104 from the proximal end to a kink in the hook. The hook has a horizontal component, which projects substantially towards the toe end of the shoe 100 in FIG. 2*b*, from the kink to the distal end of the hook.

Features of the first formation 120*a*, described with reference to FIG. 2*a*, correspond with features of the second formation 120*b*, described with reference to FIG. 2*b*, thereby to form the securement mechanism for the attachable and detachable heel. In particular, features of the first formation 120*a* are configured to receive and engage features of the second formation 120*b* so as to attach the heel 104 to the shoe body 102. Features of the second formation 120*b* in the heel 104 are visible once the heel 104 is detached from the shoe body 102, but are not visible when the heel 104 is attached to the shoe body.

The position and shape of the catch 210 correspond to the position and shape of the opening 206. When attaching the heel 104 to the shoe body, the opening is arranged to receive the catch therethrough. The position and shape of the hook 212 correspond to the position and shape of the slit 208. When attaching the heel 104 to the shoe body, the slit is arranged to receive the hook therethrough.

The distance between the kink in the hook 212 and the distal end of the hook is larger than the width of the slit 208, so that the hook can only be received through the slit when the hook is in certain positions (in particular, where the distal end of the hook enters the slit first). Similarly, the hook cannot be released back through the slit unless the hook is in similar positions.

To attach the heel 104 to the shoe body 102, the hook 212 is received through the slit 208 and engaged by other features of the first formation 120*a* as described below. The catch 210 is then received through the opening 206 and engaged by features of the first formation 120*a* as described below.

The opening 206 and slit 208 therefore form two points of connection between the shoe body 102 and the attachable and detachable heel 104. The opening and slit are positioned at opposite sides of the integral heel 124 to optimize the securement of the attachable and detachable heel 104.

The position and shape of the groove 204 of the first formation 120*a* correspond with the position and shape of the ridge 214 of the second formation 120*b*. When the attachable and detachable heel 104 is attached to the shoe body 102, the groove receives the ridge to prevent lateral movement of the heel 104 and thus aid the securement of the heel 104.

Figure 3B:
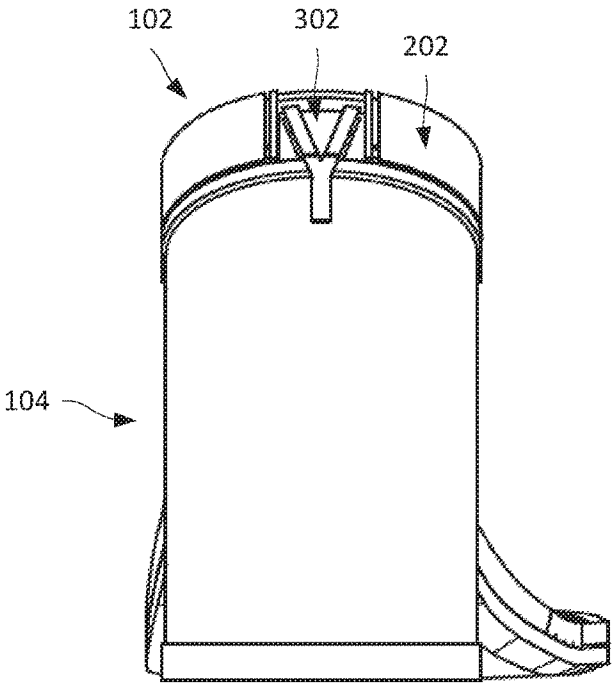
Figure 3A:
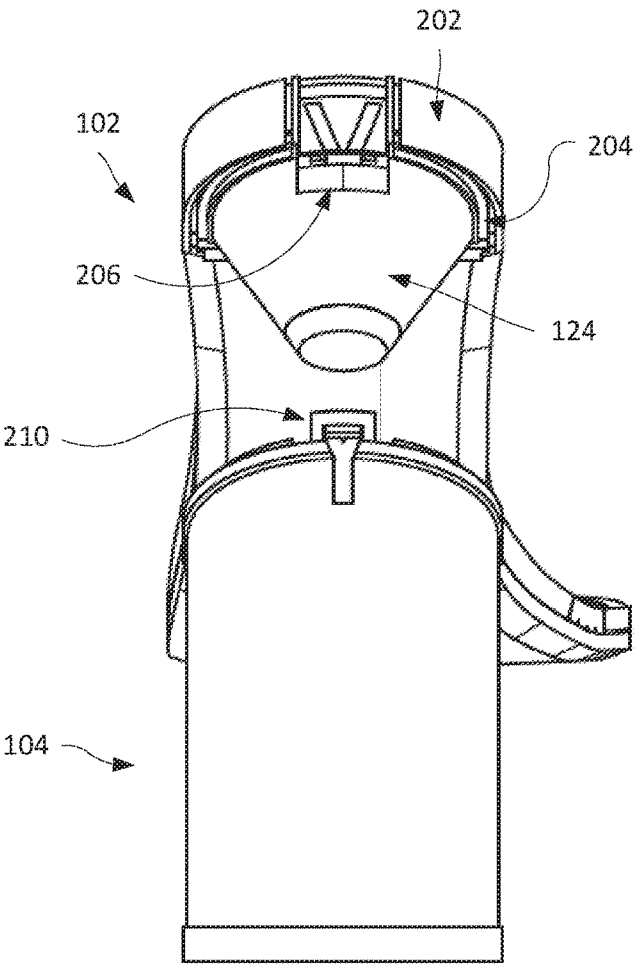

FIGS. 3*a* and 3*b* are views of the shoe assembly, in disassembled and assembled form respectively, as viewed from behind. FIG. 3*a* shows an alternative view of the integral heel 124, the attachable and detachable heel 104, the lip 202, and the groove 204. FIG. 3*a* also shows that the position of the catch 210 corresponds to the position of the opening 206 at the rear of the shoe (in that the two are aligned), where the catch is positioned so that it is received through the opening when the heel 104 is attached to the shoe body 102.

FIG. 3*b* shows the shoe in assembled form. The lip 202 covers all of the features of the securement mechanism 120 when the heel 104 is attached to the shoe body 102. At the rearmost point of the shoe body, the gap in the lip 202 is occupied by a button 302, which forms a release mechanism 122 for releasing the securement mechanism 120. Actuating the release mechanism causes the first formation 120*a* of the securement mechanism 120 to disengage the catch 210, and thereby cease to retain the catch and allow the heel 104 to become detached from the shoe body 102.

The button 302 is located on the rearmost point of the outside of the shoe body 102, on the (outer) side of the sole (i.e. the surface extending between the insole and outsole). This location allows the user of the shoe easy access to the button 302, in particular allowing a user to actuate the release mechanism to detach the heel 104 without taking off the shoe 100. It is likely that the user may wish to attach or detach the heel 104, so as to change the heel height of their shoe, when there is no suitable location nearby where they can remove their shoes, for instance when commuting outdoors to work. Therefore, it is particularly advantageous that heels can be changed quickly and easily without requiring removal of the shoes.

The button 302, or any alternative release mechanism, may be instead be located on any other easily accessibly parts of the shoe to provide the same advantage, in particular any outer side of the shoe which is not the outsole and/or the surface which faces the ground when the shoe is used in a standing position. For example, the means for actuating the release mechanism may be located: on the attachable and detachable heel 104; on a different side of the sole 108, such as the rear left or right sides of the sole; or on a portion of any upper that is attached to the shoe.

Figure 4:
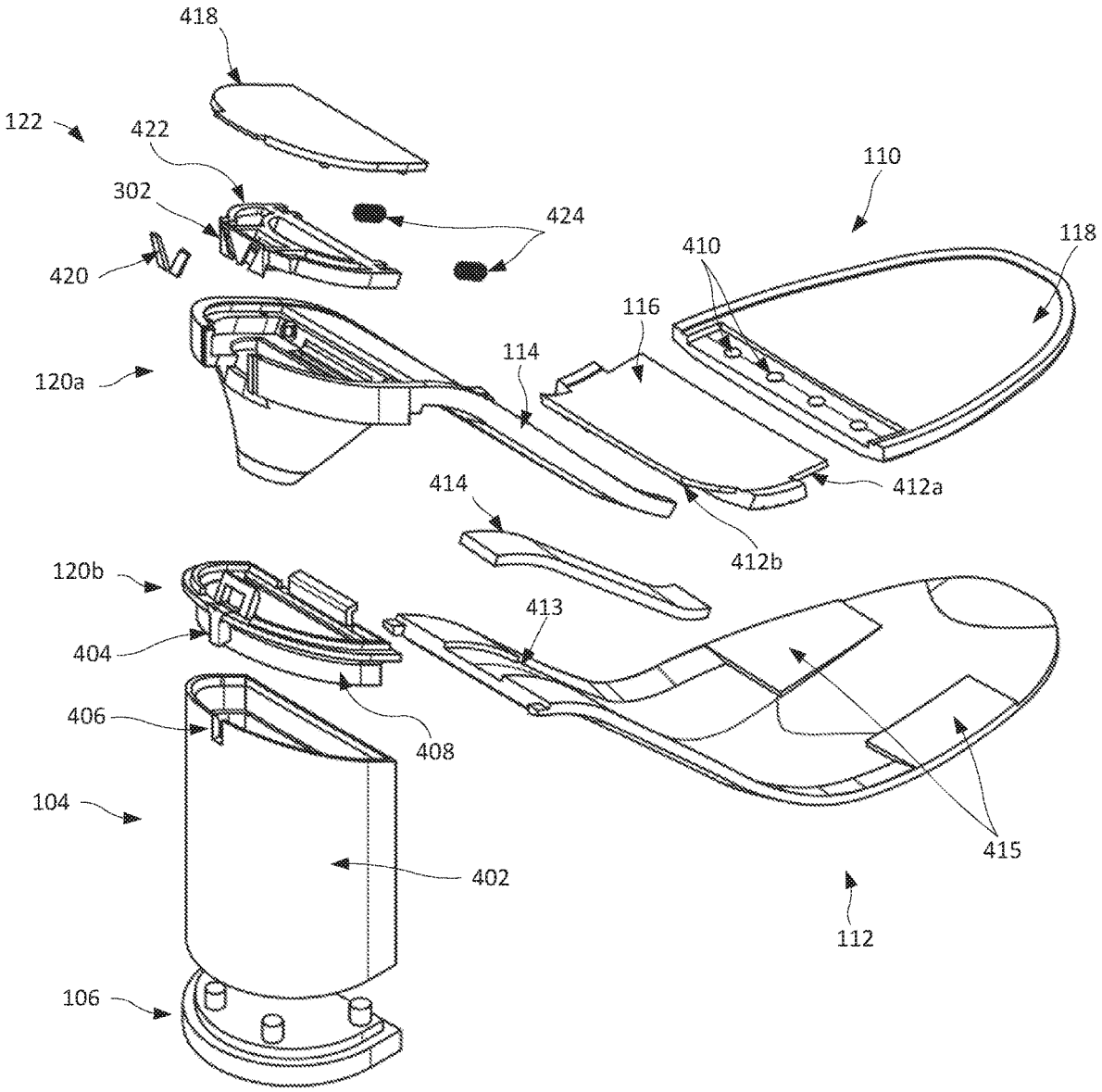
FIG. 4 is an exploded view of the shoe assembly.

FIG. 4 is an exploded view of the shoe assembly, aspects of which are described with reference to FIGS. 5 to 8.

The attachable and detachable heel 104 has three component parts: the second formation 120*b* of the securement mechanism 120; a hollow heel body 402; and the heel cap 106. The second formation 120*b* and the heel cap 106 are separable from the heel body 402.

The toe part 118 of the insole 110 has a plurality of fixing points 410 positioned on a recessed portion on the toe part 118. The flexible part 116 has a first flap 412*a* shaped to fit within the recessed portion of the toe part 118. The flap 412*a* has studs (not shown) on its underside which fit within the fixing points 410 of the recessed portion of the toe part 118 thereby to connect the flexible part 116 and toe part 118. The heel part 114 has a recessed a portion with fixing points (not shown) equivalent to that of the toe part. The flexible part has a second flap 412*b* with studs equivalent to the first flap 412*a* for connecting the heel part to the flexible part. The outsole 112 has a seat 413 for a shank 414, which acts to stabilize and provide support for the sole. The outsole has attachment points 415 for attaching parts of the shoe upper (not shown) to the shoe body 102. For example, a strap for securing the shoe to a user's foot may be attached to the shoe body via the attachment points 415. The material and style of the strap is variable depending on the style of the shoe, and so the attachment points are configured so as to be suitable for attaching various materials to the shoe body.

At the rear of the shoe body, the first formation 120*a* of the securement mechanism 120 (and the release mechanism 122) is shown. The formation 120*a* sits within the rear of the sole 108 of the shoe and is covered by a cap 418. The button 302 forming the release mechanism 122 has cut out portions on its outer face to receive a decorative element 420.

The first formation 120*a* has a resilient component. The resilient component is arranged so that actuation of the release mechanism is configured to compress the resilient component. The resilient component is a spring loaded plate 422 and springs 424. As will be appreciated, the button 302 is integral to the spring loaded plat, and effectively is simply an extension which extends through a gap in the sole. It will further be appreciated that the release mechanism is thus effectively part of the securement mechanism, and vice versa, so these terms may be used interchangeably.

Figure 5:
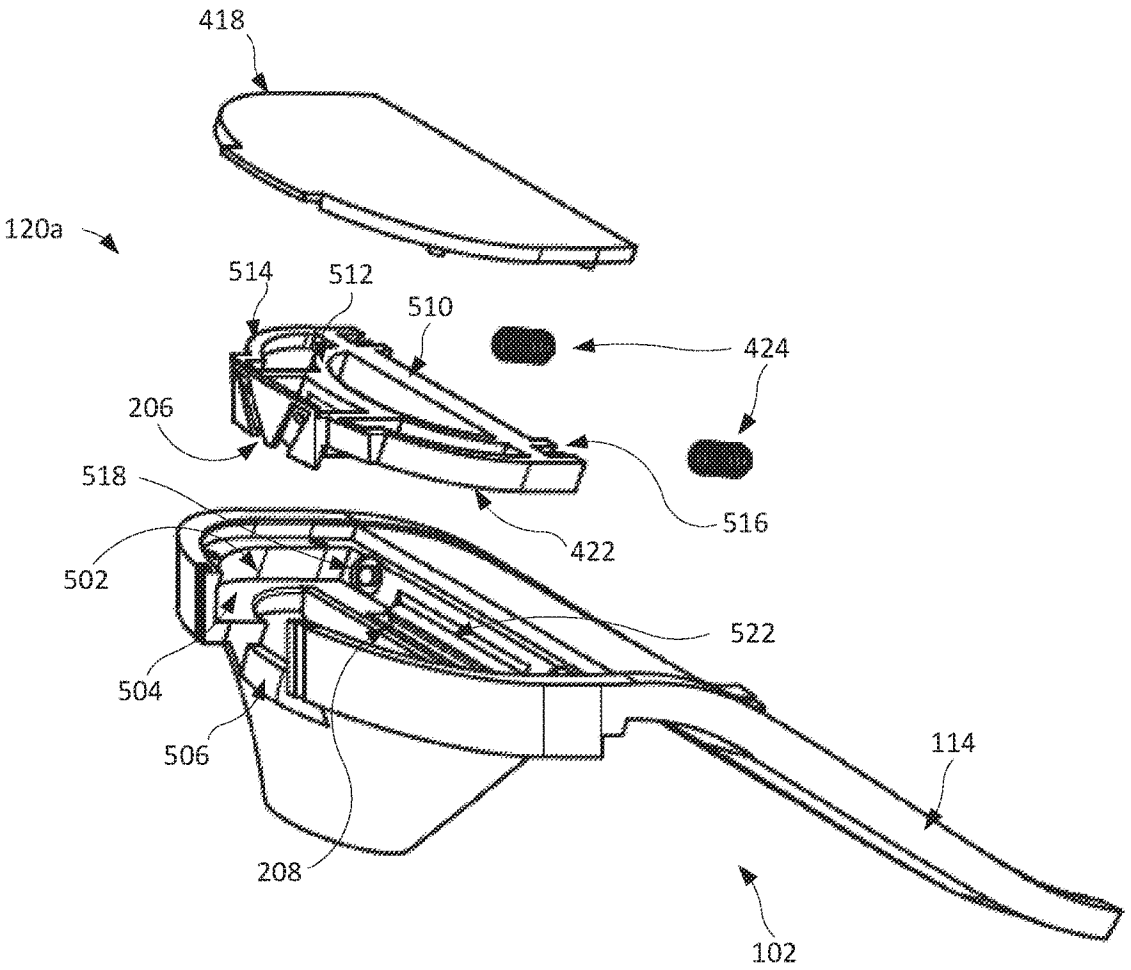
FIG. 5 is an exploded view of aspects of the first formation of the securement mechanism and the release mechanism.

FIG. 5 is an exploded view of aspects of the first formation 120*a* of the release mechanism 122.

The rear part of the shoe body 102 has a cavity 502. The cavity has a shelf 504 and a protrusion 506, which together form a seat for the first formation 120*a*. The first formation 120*a* comprises a spring loaded plate 422 which has a crossbar 510, a first arc 512, and a second arc 514 concentric with the first arc. The first and second arcs are substantially semicircular. The first and second arcs have extensions at their ends which protrude beyond the crossbar 510 to form bays 516 at both ends of the crossbar 510. Each of the bays 516 accommodates a spring 424. The opening of the slit 208 is in the same plane as the shelf 504. A ledge 522 is positioned on the frontward side of the slit 208 and forms part of the first formation 120*a* of the securement mechanism 120.

When assembled, the spring loaded plate 422 sits within the cavity 502. The plate 422 is supported via the second arc 514 which sits on the shelf 504. The protrusion 506 supports at the spring loaded plate 502 through the opening 206. The springs 424 in the bays 516 abut the side wall of the interior of the cavity 502 at the points 518 (one point is labelled, and a corresponding point exists—but is not visible—on the right hand side of the slit 208 in FIG. 5). The points 518 are recessed annuli, shaped to correspond to the annular springs. The recessed annuli restrict lateral movement of the spring at the point it abuts the cavity 502 walls. The cap 418 covers the spring loaded plate 422 (when the plate 422 is assembled with the springs 424 in the cavity 502) and provides a continuation of the heel part 114 of the insole 110 which supports the heel of the shoe wearer's foot in use.

Figure 6:
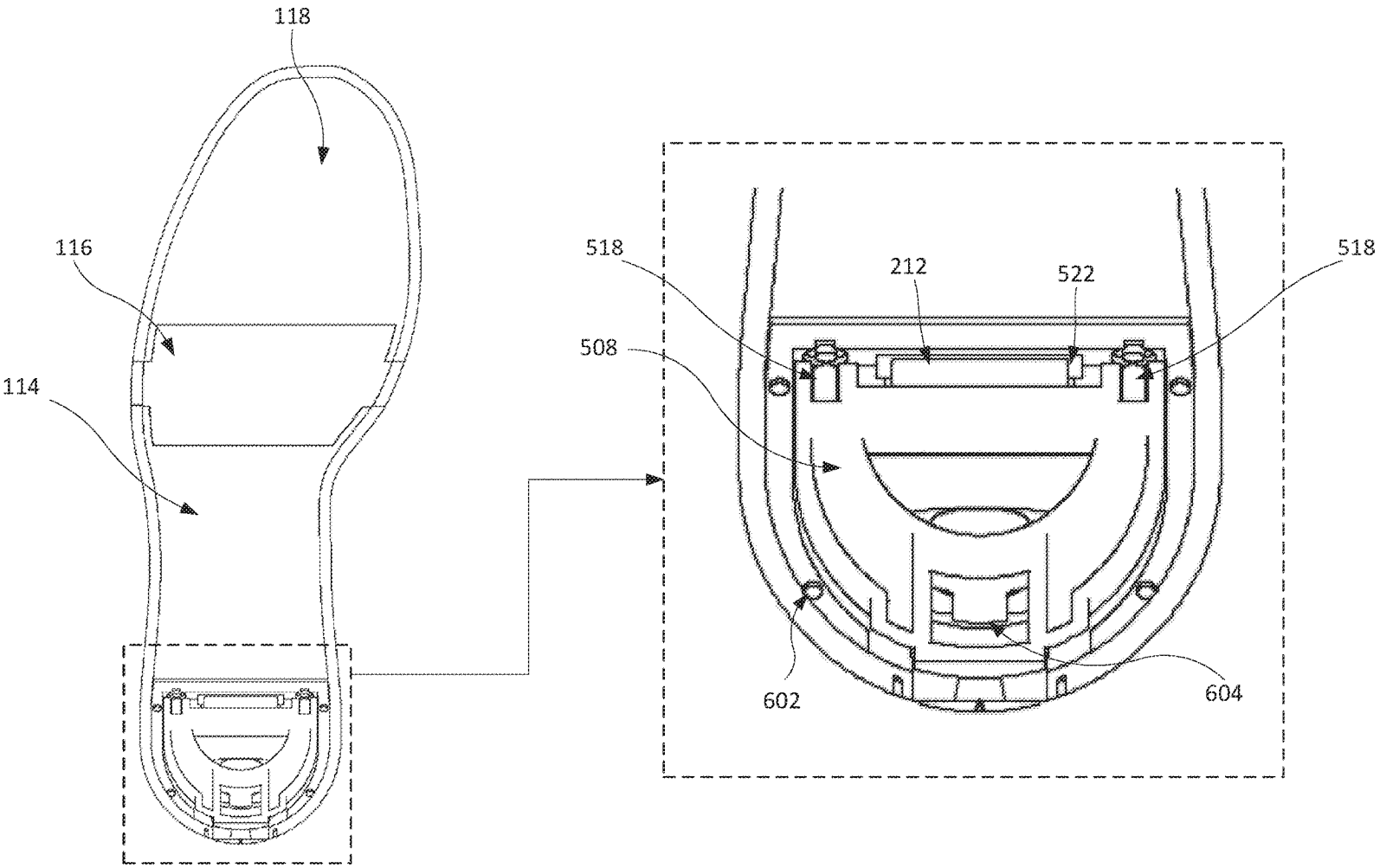
FIG. 6 is a plan view of aspects of the securement and release mechanisms.

FIG. 6 is a plan view showing up-close aspects of the assembled securement and release mechanisms (without the cap 418) where the attachable and detachable heel 104 attached to the shoe body 102.

The spring loaded plate 422 is in place, along with springs 424, within the cavity 502. A series of fixing points 602 are positioned around the interior of the cavity. The fixing points 602 are configured to receive portions of the underside of the cap 418 (when inserted) thereby to fix the cap 418 to the shoe body.

FIG. 6 shows the configuration of the securement and release mechanisms in the case that the attachable and detachable heel 104 is attached to the shoe body 102. Therefore, parts of the second formation 120*b* of the securement mechanism 120 are engaged by parts of the first formation 120*a*. The engagement is as follows. Firstly, the hook 212 is inserted through the slit and is hooked onto the ledge 522, so that it is engaged by the ledge to secure the heel 104 to the shoe body at the frontward side of the heel 104. Secondly, the catch is inserted through the opening 206 of the first formation 120*a* and is latched by a latching member 604 of the first formation 120*a* of the securement mechanism 120. The latching occurs by the latching member passing through the hole in the centre of the loop of the catch thereby to engage the catch. The latching member 604 is integral to the spring loaded plate 422 of the release mechanism.

FIG. 7*a* is an exploded view of the attachable and detachable heel.

The attachable and detachable heel 104 has three component parts: the second formation 120*b* of the securement mechanism 120; a hollow heel body 402 which comprises a cavity within it; and the heel cap 106. The second formation 120*b* and the heel cap 106 are separable from the heel body 402. The second formation of the securement mechanism is attached to the heel body by way of a protuberance 404, a notch 406, and a skirt 408. The three component parts are separable; however in use the components are secured to one another to form a single heel 104.

The protuberance 404 is configured to fit within the notch 406 to assist in securing the second formation 120*b* to the heel body 402. As well as this functional purpose, the protuberance 404 also forms a continuation of the decorative element 420 when the heel 104 is attached to the shoe body 102 thereby completing a "Y" shaped logo. The skirt 408 is configured to fit within the outer perimeter of the top of the hollow heel body 402 to affect a friction fit of the second formation 120*b* within the heel body 402.

FIG. 7*b* is a plan view of the attachable and detachable heel, with the three component parts assembled together.

The second formation 120*b*—comprising the catch 210, the hook 212, and the ridge 214—is supported on a member 702 that defines an aperture 704. When the heel 104 is attached to the shoe body 102, the integral heel 124 passes through the aperture 704 defined by the member 702 and occupies the cavity within the hollow heel body 402. The integral heel 124 and the interior of the attachable and detachable heel 104 may both be particularly shaped so that integral heel 124 may fit within detachable heel 104, optionally wherein the fit is a friction fit which assists in attaching the heel 104 to the shoe body 102.

The heel body 402 is interchangeable with a range of heel body styles, so that a user can change the heel body according to the style of heel they wish to wear with the shoe body 102. The uppermost portion of each heel body style is adapted so that, regardless of the heel body style chosen by the user, the second formation 120*b* can be secured to the heel body 402 as described. The particular shape of the heel cap 106 will vary depending on the heel body 402 style chosen by the user.

FIG. 8 is an exploded view of aspects of the securement mechanism for securing the attachable and detachable heel to the shoe body.

To attach the heel 104 to the shoe body 102, the heel 104 (which has the second formation 120*b*—shown without the rest of the heel 104 in FIG. 8) is positioned by the user at an angle to the shoe body 102 such that the heel cap 106 is angled towards the front of the shoe. Positioning the heel 104 at this angle permits a user to pass the hook 212 through the slit 208 with the distal end of the hook passing through the slit first as described above with reference to FIG. 2*b*.

Once the hook 212 is passed through the slit 208, the user rotates the heel 104 towards the upright positon (that is, the upright position of the heel 104 as shown in FIGS. 1*a* and 1*b*). In rotating the heel 104, the hook 212 is engaged by the ledge 522. The engagement of the hook with the ledge provides a pivot point against which the heel is pivoted (towards the upright position) so that the catch 210 passes through the opening 206 in the first formation 120*a*.

Features of the first formation then engage the catch so as to retain it, and thereby secure the rear of the heel 104 to the shoe body 102. In more detail, the latch 210 has a slanted face 802 which, when inserted through the opening of the first formation, presses against the latching member 604 (which is integral to the spring loaded plate 422) so as to exert a force causing the spring loaded plate 422 to move in the frontward direction (with the springs 424 being compressed against the points 518). As the heel 104 is forced further upwards, the face 802 moves past the latching member 604, so that the frontward force exerted on the spring loaded plate ceases. With no force exerted on the spring loaded plate 422, the spring 424 then expand to force the spring loaded plate towards which causes the latching member to pass through the hole of the loop of the catch 210. The latching member being through the loop of the catch 210 engages the catch thereby to secure the heel 104 at its rearward side.

To detach the heel, a user pushes the button 302, which is integral to the spring loaded plate 422, so as to actuate the release mechanism 122. When a user pushes the button 302, the spring loaded plate is depressed in the frontward direction, with the springs 424 being compressed against the points 518. The latching member, which is also integral with the spring loaded plate 422 and so moves with it, is therefore withdrawn from its position through the hole of the loop of the catch 210, thereby releasing the engagement of the latching member and the catch. With the catch releases, the heel 104 is allowed to pivot on the pivot point as described above, so that a user may pivot the heel 104 to the angle needed for the hook 212 to be withdrawn back through the slit 212. Once the hook is withdrawn through the slit, the heel 104 is entirely detached from the shoe body 102.

While the means for actuating the release mechanism is shown as a button 302, the means could alternatively comprise a toggle switch, a rotary switch, a slide switch or any other switch mechanism.

It will be understood that the invention has been described above purely by way of example, and modifications of detail can be made within the scope of the invention.

Each feature disclosed in the description, and (where appropriate) the claims and drawings may be provided independently or in any appropriate combination.

Reference numerals appearing in the claims are by way of illustration only and shall have no limiting effect on the scope of the claims.

The invention is further illustrated by the following clauses. The following clauses serve to illustrate the possibilities of combining different features of the invention in order to arrive at an embodiment according to the invention.

1. A shoe assembly, comprising:
   a shoe body having:
      a first outer side which faces the ground when the shoe is used in a standing position; and
      at least one further outer side; and
   an attachable and detachable heel for the shoe body;
   a securement mechanism for securing the heel to the shoe body; and
   a release mechanism for releasing the securement mechanism, said release mechanism being located on a further outer side.
2. A show assembly according to Clause 1, wherein the shoe body comprises a sole; the release mechanism being located on a side of the sole.
3. A shoe assembly according to Clause 1 or 2, wherein the release mechanism is located on the rear of the shoe.
4. A shoe assembly according to any preceding clause, wherein the securement mechanism comprises a resilient component and wherein actuation of the release mechanism is configured to compress the resilient component.

5. A shoe assembly according to Clause 4, wherein the release mechanism comprises a button integral to the resilient component.
6. A shoe assembly according to Clause 4 or 5, wherein the resilient component is a spring-loaded plate.
7. A shoe assembly according to any preceding clause, wherein the securement mechanism comprises a first formation in the shoe body and a second formation in the attachable and detachable heel, wherein the first and second formation are configured to engage thereby to secure the heel to the shoe body.
8. A shoe assembly according to Clause 7, wherein the shoe body further comprises an integral heel, wherein the integral heel spaces the first formation from the ground in use.
9. A shoe assembly, comprising:
   a shoe body having an integral heel; and
   an attachable and detachable heel for the shoe body;
   wherein the shoe body comprises a securement component for securing the attachable and detachable heel to the shoe body;
   wherein, in use, the integral heel spaces the securement component from the ground.
10. A shoe assembly according to Clause 8 or 9, wherein the attachable and detachable heel comprises a cavity for receiving the integral heel.
11. A shoe assembly according to any of Clauses 8 to 10, wherein the integral heel has a tapered shape.
12. A shoe assembly according to Clause 9, wherein the securement component is a first formation and the attachable and detachable heel comprises a second formation, wherein the first and second formation are configured to engage thereby to secure the heel to the shoe body.
13. A shoe assembly according to Clause 8 or 12, wherein the second formation comprises an aperture for receiving the integral heel therethrough.
14. A shoe assembly according to any of Clauses 7, 8, 12 and 13, wherein the first formation comprises a or the resilient component, wherein the second formation comprises a catch for engaging with the resilient component, such that the catch and resilient component form a latch.
15. A shoe assembly according to any of Clauses 7, 8, and 12 to 14, wherein the second formation further comprises a hook for engaging with a part of the first formation.
16. A shoe assembly according to Clause 15, wherein the hook is provided generally on an opposite side of the second formation to the catch.
17. A shoe assembly according to any of Clause 7, 8, and 12 to 16 when dependent on Clause 2, wherein the first formation is located in the sole.
18. A shoe assembly according to Clause 17, wherein the shoe body comprises a cap for covering the first formation and/or the release mechanism, wherein the cap forms part of an insole.
19. A shoe assembly according to any of Clause 7, 8, and 12 to 18, wherein the second formation is located on an upper part of the heel.
20. A shoe assembly according to any preceding clause, wherein the shoe body comprises a sole having a flexible part thereby to adapt to different heel heights.
21. A shoe assembly according to Clause 20, wherein the shoe body further comprises a shank, wherein the flexible part is located away from the shank.
22. A shoe body comprising:
   a first outer side which faces the ground when the shoe is used in a standing position; and
   at least one further outer side;
   a formation for engaging with a further formation on an attachable and detachable heel thereby to form a securement mechanism; and
   a release mechanism located on a further outer side for releasing the securement mechanism.
23. A shoe body comprising:
   an integral heel;
   a formation for engaging with a further formation on an attachable and detachable heel thereby to form a securement mechanism;
   wherein, in use, the integral heel spaces the securement component from the ground.
24. An attachable and detachable heel for a shoe body comprising a formation for engaging with a formation on a shoe body thereby to form a securement mechanism.
25. A kit of parts comprising a shoe body according to Clause 22 or 23 and a plurality of attachable and detachable heels according to Clause 24.

What is claimed is:

1. A shoe assembly, comprising:
a shoe body having an integral heel; and
an attachable and detachable heel for the shoe body;
wherein the shoe body comprises a sole; and a first formation located in the sole;
wherein the attachable and detachable heel comprises a second formation comprising an aperture for receiving the integral heel therethrough such that the second formation surrounds the integral heel,
wherein the first and second formation are configured to engage thereby to secure the attachable and detachable heel to the shoe body;
wherein, in use, the integral heel spaces the first formation from the ground;
wherein the second formation further comprises a hook for engaging with a part of the first formation, preferably wherein the hook is provided generally on an opposite side of the second formation to the catch;
wherein the shoe body comprises a cap for covering the first formation, wherein the cap forms part of an insole; and
wherein the shoe body comprises a first outer side which faces the ground when the shoe is used in a standing position; and at least one further outer side; and wherein the shoe assembly further comprises a release mechanism for releasing a securement mechanism comprising the first formation and the second formation, said release mechanism being located on a further outer side.

2. A shoe assembly according to claim 1, wherein the attachable and detachable heel comprises a cavity for receiving the integral heel.

3. A shoe assembly according to claim 1, wherein the integral heel has a tapered shape.

4. A shoe assembly according to claim 1, wherein the second formation is located on an upper part of the attachable and detachable heel.

5. A shoe assembly according to claim 1, wherein the shoe body comprises the sole having a flexible part thereby to adapt to different heel heights.

6. A shoe assembly according to claim 5, wherein the shoe body further comprises a shank, wherein the flexible part is located away from the shank.

7. A shoe assembly according to claim 1, wherein the release mechanism is located on a side of the sole.

8. A shoe assembly according to claim 1, wherein the release mechanism is located on a rear side of the shoe.

9. A shoe assembly according to claim 1, wherein the securement mechanism comprises a resilient component and wherein actuation of the release mechanism is configured to compress the resilient component, preferably wherein the release mechanism comprises a button integral to the resilient component.

10. A shoe assembly according to claim 9, wherein the resilient component is a spring-loaded plate.

11. A shoe assembly according to claim 1, wherein the securement mechanism comprises a first formation in the shoe body and a second formation in the attachable and detachable heel, wherein the first and second formation are configured to engage thereby to secure the heel to the shoe body.

* * * * *